US009159211B2

(12) United States Patent
O'Brien et al.

(10) Patent No.: US 9,159,211 B2
(45) Date of Patent: Oct. 13, 2015

(54) REMOTE MONITORING SYSTEM WITH CELLULAR GATEWAY

(71) Applicant: Sensored Life, LLC, Penn Yan, NY (US)

(72) Inventors: Michael O'Brien, Penn Yan, NY (US); James Odorczyk, Penn Yan, NY (US)

(73) Assignee: Sensored Life, LLC, Penn Yan, NY (US)

( * ) Notice: Subject to any disclaimer, the term of this patent is extended or adjusted under 35 U.S.C. 154(b) by 121 days.

(21) Appl. No.: 14/060,789

(22) Filed: Oct. 23, 2013

(65) Prior Publication Data

US 2014/0118135 A1 May 1, 2014

Related U.S. Application Data

(60) Provisional application No. 61/718,271, filed on Oct. 25, 2012.

(51) Int. Cl.

| | |
|---|---|
| ***G08B 1/08*** | (2006.01) |
| ***G08B 19/00*** | (2006.01) |
| ***G08B 25/08*** | (2006.01) |
| *G08B 25/00* | (2006.01) |

(52) U.S. Cl.

CPC ..... *G08B 19/00* (2013.01); *G08B 25/08* (2013.01); *G08B 25/009* (2013.01)

(58) Field of Classification Search

CPC ..... G08B 21/182; G08B 19/00

USPC ..... 340/539.11, 584, 588, 622, 628, 340/539.26, 539.27

See application file for complete search history.

(56) References Cited

U.S. PATENT DOCUMENTS

| | | | | |
|---|---|---|---|---|
| 4,577,182 | A | 3/1986 | Millsap et al. | |
| 7,623,028 | B2 * | 11/2009 | Kates | 340/521 |
| 7,952,485 | B2 | 5/2011 | Schechter et al. | |
| 2011/0230160 | A1 * | 9/2011 | Felgate | 455/404.1 |

* cited by examiner

*Primary Examiner* — Toan N Pham

(57) ABSTRACT

A method for monitoring at least one ambient condition at a remote site, the method executed at least in part by a computer, configures at least one sensing device at the remote site according to one or more setup instructions transmitted wirelessly from a host processor at a first site, wherein the configuration associates the at least one sensing device with a personal communications device wherein the at least one sensing device is energizable to wirelessly transmit, to the personal communications device, a sensor signal that is indicative of the at least one ambient condition according to the setup instructions. In response to the transmitted sensor signal, information about the at least one ambient condition displays on the personal communications device that is associated with the at least one sensing device.

18 Claims, 5 Drawing Sheets

300

REMOTE MONITORING SYSTEM WITH CELLULAR GATEWAY

CROSS REFERENCE TO RELATED APPLICATIONS

This patent application claims the benefit of priority to U.S. Provisional Patent Application Ser. No. 61/718,271, entitled "REMOTE ALARM SYSTEM," filed on Oct. 25, 2012, which is hereby incorporated by reference herein in its entirety.

FIELD OF THE INVENTION

The present application relates generally to remote sensing and reporting and more particularly to methods and apparatus for providing remote monitoring for homes and other property.

BACKGROUND OF THE INVENTION

The ability to determine ambient conditions at a remote site is of value to any owner of property when the owner is not in residence. When irregular conditions indicative of impending mishap or damage are detected, such as exceedingly low temperature or high humidity, an alert can be sent to the owner or his agent in time to minimize or prevent damage. In particular, owners of vacation homes benefit from remote sensing when conditions indicative of potential damage are detected and communicated to the owner.

A common means of monitoring is to have a neighbor or watch service monitor the remote property. This can be unreliable and puts at risk the objective of being alerted of certain conditions in a timely fashion. For example, if a failure occurs shortly after a monitoring visit, it can be many days or weeks until that failure is detected, and by then the damage will have already occurred.

Remote alarm systems using wired connections are well known. One such system is the Sensaphone® 400—Remote Monitoring and Control System. However, such systems require that a wired connection be maintained, and in the case where a telephone or internet line is used to connect the sensor or sensor monitor and provide a means for alerts to be sent, equipment must be provided to communicate over the line. Furthermore, the telephone or internet line must be functional. This can be particularly problematic during periods of severe weather, when above-ground communication lines are prone to mechanical disconnection and below-ground lines are prone electrical disconnection due to flooding. Additionally, the cost for providing and maintaining such lines can be significant.

In U.S. Pat. No. 4,577,182, Millsap et al. propose a remote alarm system in which alarms are sent via a cellular phone connection. An alarm system is provided in which an alarm condition causes a cellular transceiver to automatically transmit a telephone call to an alarm monitoring station by over-the-air transmission of a signal to a cellular site. A computer at the cellular site provides communication between the cellular transceiver and an alarm company monitoring station.

Schechter et al., in U.S. Pat. No. 7,952,485, describe a similar system in which alert conditions are sent to a remote server. Units are registered and reporting times are established. Customers are alerted to conditions violating established limits.

What is needed is a remote sensing unit that can be easily installed and configured, that uses wireless cellular connectivity to send alerts, and that provides for additional sensing capabilities.

SUMMARY OF THE INVENTION

The present invention is directed to overcoming one or more of the problems set forth above. Briefly summarized, according to one aspect of the invention, the invention provides a low cost system that allows sensing and reporting of conditions at remote locations. Additionally, the system provides a means of adding additional wireless sensors to a location for the purpose of sensing additional conditions at different locations within the radio frequency range of the remote sensing devices. Additional utility is added to the remote sensing device by adding additional sensors which report through the sensing device.

According to an embodiment of the present invention, there is provided a method for monitoring at least one ambient condition at a remote site, the method executed at least in part by a computer and configuring at least one sensing device at the remote site according to one or more setup instructions transmitted wirelessly from a host processor at a first site, wherein the configuration associates the at least one sensing device with a personal communications device, wherein the at least one sensing device is energizable to wirelessly transmit a sensor signal that indicates a change in at least one ambient condition, according to the setup instructions; and displaying, in response to the transmitted sensor signal, information about the at least one ambient condition on the personal communications device that is associated with the at least one sensing device.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

It is believed that the invention will be better understood from the following description when taken in conjunction with the accompanying drawings, wherein.

DETAILED DESCRIPTION OF THE INVENTION

Figure 1:
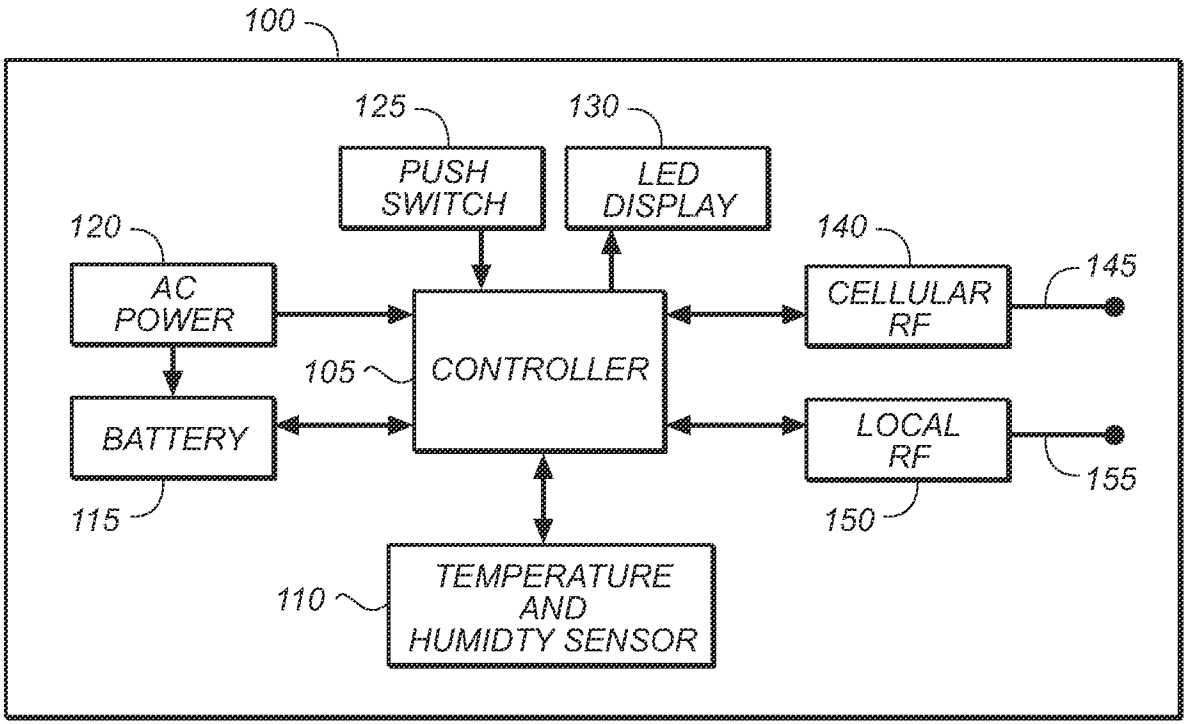
FIG. 1 is a schematic diagram of a remote sensing device of the present invention.

In the context of the present disclosure, the term "ambient condition" relates to a measurable environmental variable that can be normal or outside expected levels at a remote site. The ambient condition that is sensed may relate to heat, humidity, pressure, noise, movement, light level, power loss, or other variable parameter that can indicate a problem at the remote site.

Where they are used, the terms "first", "second", "third", and so on, do not necessarily denote any ordinal or priority relation, but may be used for more clearly distinguishing one element or time interval from another.

As used herein, the term "energizable" relates to a device or set of components that perform an indicated function upon receiving power and, optionally, upon receiving an enabling signal.

In the context of the present disclosure, the general term "personal communications device" is broadly used to encompass any of a number of types of handheld wireless portable personal communications devices that are carried by a user, including cellular phones, so-called "smartphones" that provide some type of mobile operating system, feature phones having at least some measure of computing capability, and various types of wireless, networked electronic pads, tablets, and similar devices that may or may not include a phone and that include at least a display area capable of displaying text and graphic content. These devices can include a scanner or camera and a mechanism for entering data, such as phone numbers, message text, and prompt responses, for example. The mechanism for data entry typically includes a touch screen and may also include a keypad. Examples of handheld customer communications devices that can be particularly useful for embodiments of the present invention include commercially available smartphones such as the Android™ smartphone platform (Android is a trademark of Google, Inc.), the iPhone (from Apple Inc.), and devices with similar capability for downloading and executing one or more sets of programmed instructions, such as software applications that display on the device. The term "personal communications device" can also include various types of devices that can receive and provide alert messages, including wired phones, pagers, and laptop and other portable computers, for example.

In the context of the present disclosure, the term "in signal communication" means that two or more devices and/or components are capable of communicating with each other via signals that travel over some type of signal path. Signal communication may be wired or wireless. The signals may be communication, power, data, or energy signals which may communicate information, power, and/or energy from a first device and/or component to a second device and/or component along a signal path between the first device and/or component and second device and/or component. The signal paths may include physical, electrical, magnetic, electromagnetic, optical, wired, and/or wireless connections between the first device and/or component and second device and/or component. The signal paths may also include additional devices and/or components between the first device and/or component and second device and/or component.

A remote alarm system with easy-to-use sensing units is described. In the embodiment of FIG. 1, sensing device 100 placed at the remote location has components connected to controller 105, such as a dedicated processor. Temperature and humidity sensor 110 such as the Sensirion SHT21 sensor from Sensirion AG, Switzerland; battery 115; AC power input 120; push switch 125; and LED (Light Emitting Diode) display 130 such as Green 0603 570 nm LED by Kingbright, Taiwan, are connected to controller 105. In addition, controller 105 is connected to a plurality of radio frequency transceivers 140 and 150, which are connected, respectively to antennas 145 and 155. The cellular radio frequency transceiver 140 allows connection to a cellular radio tower and provides connectivity to a remote server. The local radio frequency transceiver 150 connects to other local devices via a local connection using a short range radio frequency technology, such as a Zigbee compatible or Z-Wave protocol compatible technology, and allows connection between sensing device 100 and additional sensors within the range of local radio frequency transceiver 150. In some cases, local radio frequency transceiver 150 will only receive signals and not transmit.

Controller 105 receives power from AC power input 120. Controller 105 also monitors the power supply from AC power input 120 for interruptions. An interruption must occur for longer than some predetermined measure of time, such as 8 to 10 seconds, to be considered a true interruption. AC power input 120 also charges battery 115. Controller 105 uses power supplied by battery 115 when the supply of power from AC power input 120 is interrupted. Push switch 125 is actuated by the user to provide input to controller 105 such as that the unit is being removed from service and need not send an alert. LED display 130 is driven by controller 105 to provide status information to the user. Temperature and humidity sensor 110 delivers data to controller 105 indicative of the ambient conditions for temperature and humidity. Firmware in controller 105 uses algorithms to adjust the temperature and humidity data from temperature and humidity sensor 110 to account for heat caused by the internal components of the sensing device 100 such as the heat given off by the charging of the battery. Controller 105 uses cellular radio transceiver 140 and antenna 145 to communicate with remote cell towers and local radio frequency transceiver 150 and antenna 155 to communicate with local devices.

According to an alternate embodiment of the present invention, a direct current (DC) power source is used instead of AC power input 120. The use of a DC power source may be advantageous at a particular site, such as due to regulatory requirements, for example.

Figure 2:
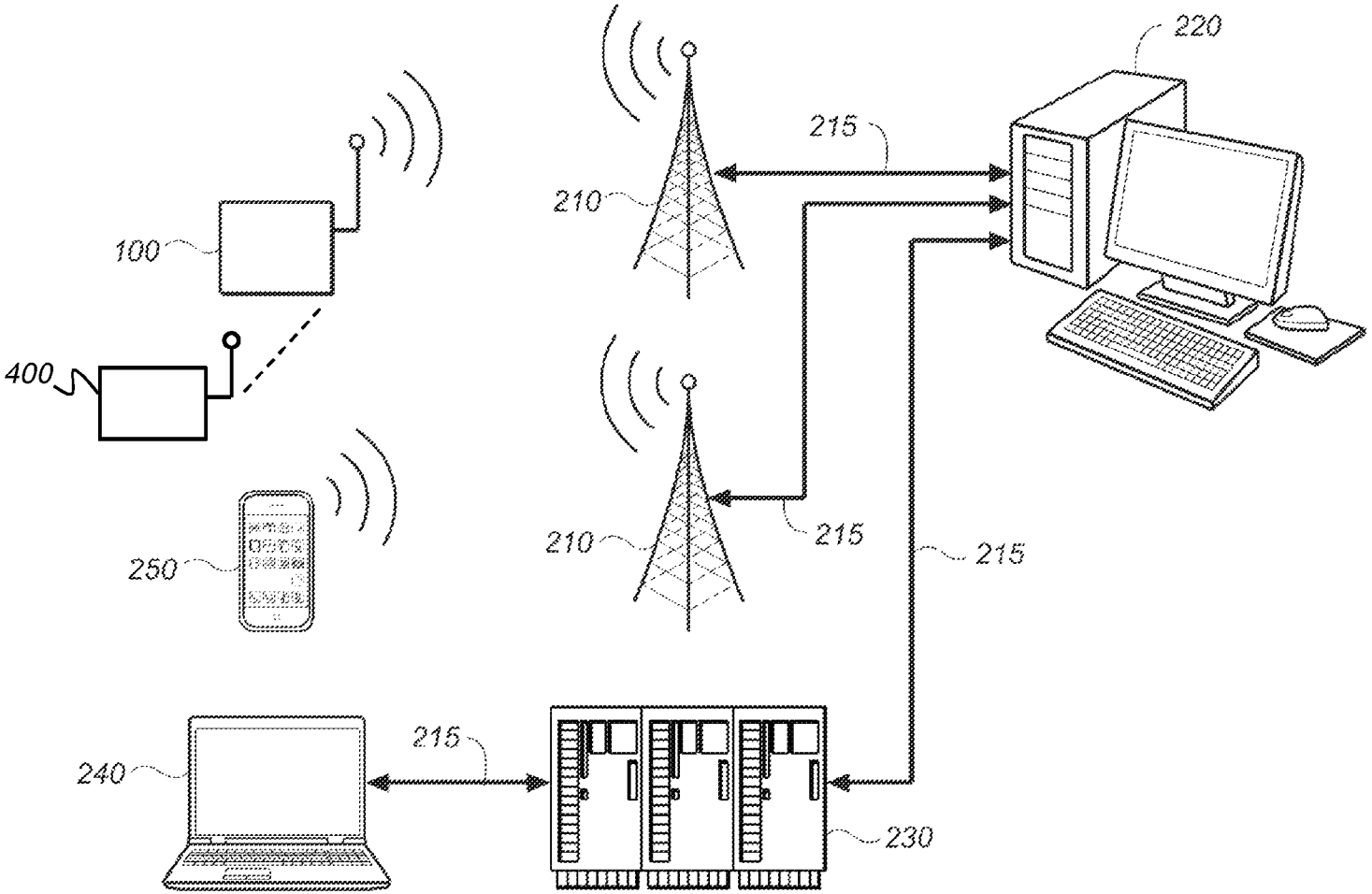
FIG. 2 is a schematic diagram of the system of the present invention.

FIG. 2 shows the system block diagram of the remote alarm system. Sensing device 100 is placed at the remote location where monitoring is desired and is energizable to wirelessly transmit a sensor signal that is indicative of at least one ambient condition. Sensing device 100 can be battery powered or can be connected to AC power at any outlet. For obtaining setup instructions and providing sensor signal information, sensing device 100 is in signal communication with cellular communication network 210 by means of a radio frequency connection such as that commonly used for cellular telephony. Cellular communication network 210 is in signal communication with a host processor 220 or other server at a different site, such as by means of a wired connection. Host processor 220 is in signal communication with website server 230 which is connected to user computer 240. A personal communications device 250 such as a cell phone, smartphone, or other type of personal communications device that can receive phone calls and text messages can be designated to receive messages intended to provide status or alarms data. Personal communications device 250 can be a smart phone, for example, having data processing capability and access to memory storage. Though a single cellular communication network 210 can be used to communicate with both sensing device 100 and personal communications device 250, it is understood that a different cellular communication network 210 is likely to communicate with user personal communications device 250 when delivering alert messages. Note that a land line connection and land line phone (not shown) can serve as personal communications device 250 to receive alerts.

When sensing device 100 is plugged into power at the remote site, it initiates communication with host processor 220 using wireless transmission, such as over cellular communication network 210. Via this cellular connection and the internet, as indicated by line 215, sensing device 100 communicates with host processor 220. This wireless connection is also used to provide one or more setup instructions to sensing device 100 and to transmit a sensor signal that can include one or more status messages that are indicative of at least one ambient condition from sensing device 100 to host processor 220. According to an embodiment of the present invention, sensing device 100 initiates a TCP/IP session with host processor 220 over the cellular or other wireless connection. This transmission can be automatically performed at fixed intervals and used to send readings of data related to the ambient condition for the last period of time; alternately, transmission can be initiated by an event such as an out-of-range ambient condition, or to provide an alarm signal if temperature or humidity sensing detects a change or has gone out of range or if the power is off, for example. Host processor 220 responds with any temperature or humidity range values that have been changed by the user since the last call. These values can be treated as threshold values; sensing of a temperature, humidity, or other ambient condition that is outside the range of threshold values sets an alarm condition for sensing device 100 and enables sensing device 100 to initiate a call whenever out-of-range conditions are detected.

Using computer 240 or other device that is capable of web site access, such as a smartphone, tablet computer, or game console, for example, the user connects to web host server 230 via the internet, indicated by a second line 215. In order to select options for sensing device 100, the user accesses a website by means of an address or URL such as that addressed in the form a.b.c.; wherein a is typically the conventional address portion "www"; b is an appropriate name such as "sensoredlife"; and c gives the web site type, typically "com".

Web server 230 communicates these options via the internet, indicated by a third line 215, to host processor 220. Host processor 220 stores the options for sensing device 100. Because it is in signal communication with the device, host processor 220 can also deliver new instructions in software or firmware to controller 105 on sensing device 100.

Figure 3:
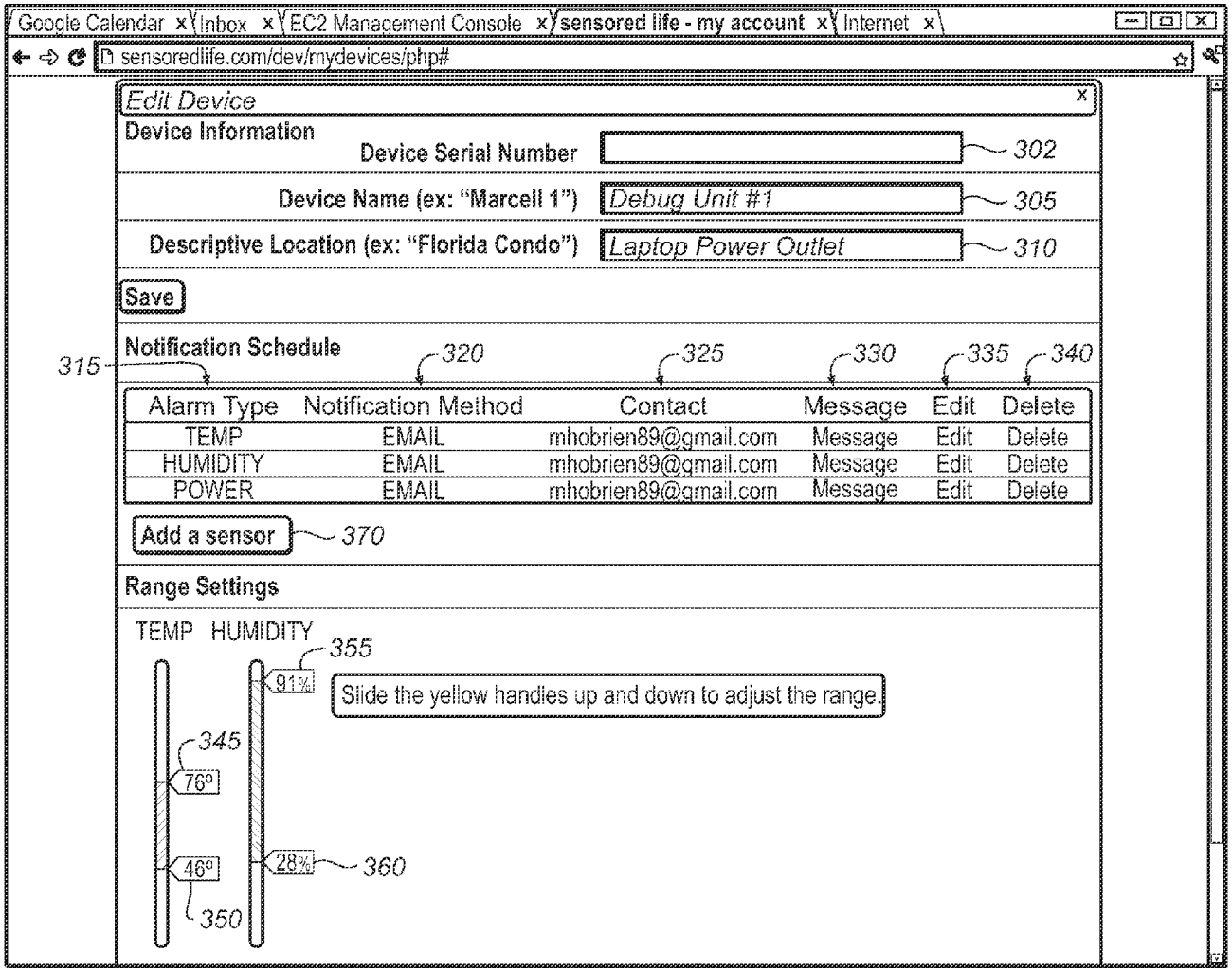
FIG. 3 illustrates a data entry screen enabling communication between the sensing device and the user.

The user defines and sets alarm conditions via a website. FIG. 3 shows a selection screen 300, which appears on computer 240 after connection to web server 230. According to an embodiment of the present invention, selection screen 300 is a web page that collects user input entries and associates each sensing device with a device for displaying status or alarm information, such as with a personal communications device 250. For example, the user enters the serial number assigned to sensing device 100 on line 302. To facilitate ease of use, a user-selected name for the device is entered on line 305 and a descriptive location for the device on line 310. Column 315 denotes the Alarm Type. The Alarm Types shown include Temperature, Humidity and Power. Column 320 denotes the type of alarm that is to be sent when boundary conditions are exceeded or a change in measurement is detected. When any boundary conditions are exceeded or other preset conditions are met, or when power is lost for a predetermined amount of time, such as over 8 to 10 seconds, the device is in an alarm sending state. For example, when temperature and humidity sensor 110 goes out the range set by the user, an alarm sending state occurs. On this example of screen 300, an email alert has been selected for each alarm type in column 320. However, a text message or a phone call can alternately be selected, including a phone call with a recorded or synthesized voice message, for example. Column 325 indicates the contact address that is to be used for sending alerts. This example shows email addresses because the notification method selected in column 320 is email. If a text message or phone message is alternately selected, the phone number of the receiving personal communications device 250 is indicated as the contact address that is associated with the sensor device. The desired message to be sent is selected in column 330. The user can view the current message in column 330 or change notification type 320, contact 325, or message 330 by selecting editing column 335. Column 340 is used to delete all the information associated with a particular alarm type denoted in column 315. It can be appreciated that other parameters for a sensor can also be entered, such as values for time interval between transmissions to periodically test the wireless cellular gateway communication, for example.

In the embodiment shown in FIG. 3, ranges of acceptable operation are set by moving slider indicators to the appropriate threshold values. Upper temperature limit 345 sets the maximum allowable temperature value. Lower temperature limit 350 sets the minimum allowable temperature value. Similarly, upper humidity limit 355 sets the maximum allowable humidity value; lower humidity limit 360 sets the minimum allowable humidity value. Whenever sensing device 100 detects values that are outside the range of the selected maximum and minimum values delivered by host processor 220, or detects a measurable change, or if power to sensing device 100 has failed or the power to sensing device 100 has been restored, sensing device 100 transmits this data to host processor 220. If the designated alert type notification method in column 320 is by phone, the selected alarm message is sent from host processor 220 to the selected personal communications device 250. For example, the phone message that may be recorded or synthesized and delivered to personal communications device 250 can announce, "Temperature alert—temperature is out of range. Please take action. Current temperature is 91, humidity is 78 and power is on. Unit location is cottage on Keuka Lake." Additionally, the alert database at host processor 220 can be accessed by computer 240 (FIG. 2).

In practice, a user obtains sensing device 100 and plugs it into any AC outlet or other suitable source, such as a DC power supply, within the property that will be monitored. Via cellular communication network 210, sensing device 100 and host processor 220 establish communication. If the user has previously set conditions via selection screen 300, the alert limit values are sent to sensing device 100 so that it can contact host processor 220 immediately when the limits have been exceeded, or if the AC or DC power has failed. If the limits have not been exceeded, sensing device 100 reports its functional status at some pre-determined interval, such as every 6 hours. If the user has not yet set alert conditions, default values are used until these values are changed.

Data from sensing device 100 is stored over time at host processor 220 or some other remote storage device (not shown). The stored data can be accessed by the user from computer 240 or from personal communications device 250 if the personal communications device 250 has the capability to access websites. The visual display presentation can take the forms of graphs or statistical measurements.

In some circumstances, the user will benefit from having additional conditions monitored. For example, a moisture sensor placed in a basement can provide an indication of flooding. A motion detector can be placed in an area where there should be no motion so that various conditions can be observed such as someone opening a safe, liquor cabinet, jewelry case, or gun case, for example. Also, while sensing device 100 monitors temperature and humidity in the area in which it is located, there are frequently other locations within the property where additional monitoring is desired or preferred. Sensing device 100 can be placed at an outlet on the first floor of the property, but there is often a need to monitor a basement where cellular connectivity can be difficult.

Figure 4:
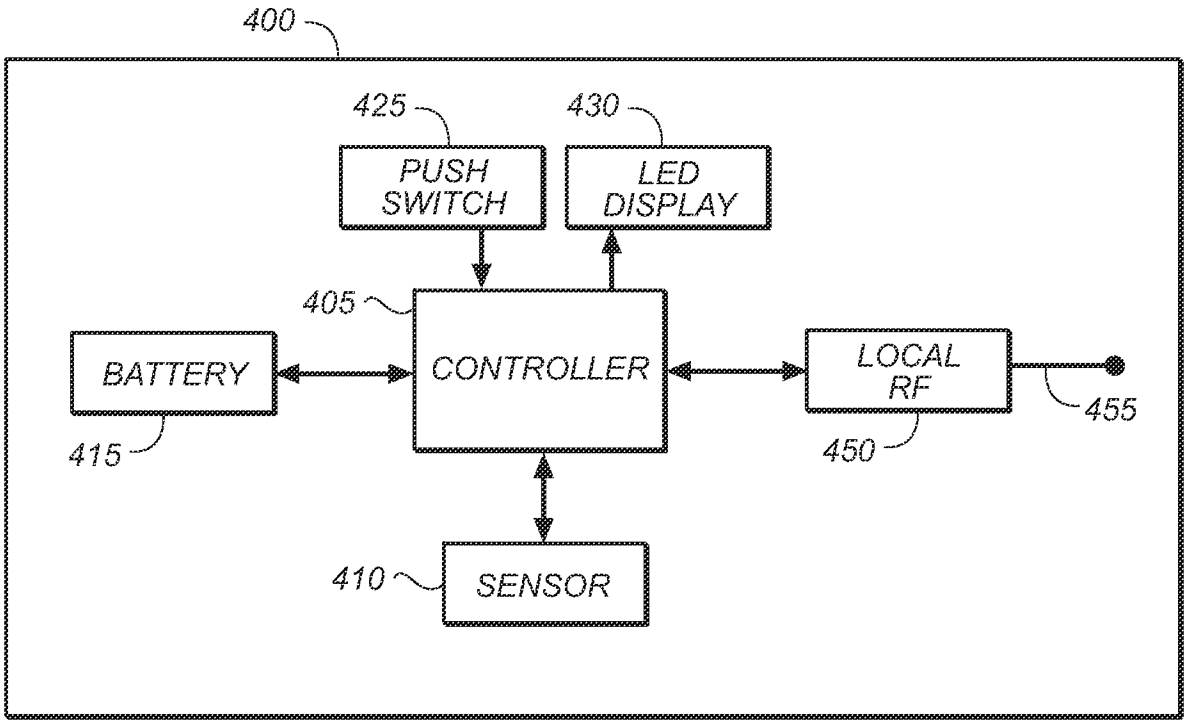
FIG. 4 is a schematic diagram of an additional sensing device.

FIG. 4 shows the block diagram of a system in which an additional auxiliary sensing device 400 is working in conjunction with a primary sensing device 100 of FIGS. 1 and 2.

FIG. 2 shows one auxiliary sensing device 400 in signal communication with sensing device 100 and using sensing device 100 as a type of cellular data gateway. Battery 415 or other suitable source powers controller 405. Local RF 450 and antenna 455 enable wireless communication with sensing device 100. Push switch 425 is a means for the user to provide input to controller 405. Sensor 410 is representative of a plurality of different types of sensors. Sensor 410 may be the same temperature and humidity gauge 110 as in sensing device 100. Providing duplicate sensors allows additional temperature and humidity monitoring within the range of local communication enabled by local RF transceivers 450 and 150. This can be advantageous in a structure where cellular connectivity is not achievable in the desired monitoring location. Sensor 410 may be of a different type for sensing different conditions. Sensor 410 can be a simple contact closure sensor. When sensor 410 is a motion sensor it can be used to detect the presence or absence of motion such as a storage safe in a particular location, or a door in a particular position. Sensor 410 can be a vibration sensor such as Model 834 Accelerometer from Measurement Specialties, Aliso Veijo, Calif., US. When sensor 410 is a vibration sensor it can be used to detect undesirable vibratory motion on an appliance such as on a water pump. When sensor 410 is an accelerometer sensor it can be used to detect undesirable movement for an object such as a hurricane shutter. When sensor 410 is a water or humidity sensor it can be used to detect when water is leaking from a pipe, toilet tank, or hot water heater. Whenever conditions monitored by sensor 410 are detected, transmissions are made to sensing device 100, and sensing device 100 is placed in an alarm sending state.

Though auxiliary sensing device 400 can be a local radio frequency transceiver, according to an embodiment of the present invention, device 400 is only a transmitter. In this case, collision detection or compensation algorithms are used to accept data from device 400 at primary sensing device 100. A backoff algorithm or some other method is used to stagger the sending of packets between sensors. For example, the remote device will send the packet at least 3 times using a differing amount of time between each transmission of the packet. In the case where auxiliary sensing device 400 has a local radio frequency transceiver 450, verification of receipt of data can be sent from primary sensing device 100 to device 400. Primary sensing device 100, acting as a type of wireless data gateway, sends update data to host processor 220 corresponding to data received from device 400. When data from device 400 causes primary sensing device 100 to be in an alarm sending state, an alert is sent to the user personal communications device. Alerts can also be sent to the user when communication between primary sensing device 100 and device 400 has occurred. This can happen, for example, when running water is detected by water sensor 410. When communication does not occur within a predetermined time interval, such as for example, once every six hours, host processor 220 can send out an alert to the user according to the mechanisms identified in FIG. 3. Optionally, a default error message can be sent and displayed.

Signal communication between primary sensing device 100 and auxiliary sensing device 400 must be initialized so that primary sensing device 100 is aware that there is at least one auxiliary sensing device 400 in signal communication with and reporting to primary sensing device 100 as a wireless data gateway. In a case where a plurality of auxiliary sensing devices 400 are installed in a local area, primary sensing device 100 must know which auxiliary sensing device 400 is reporting to primary sensing device 100 at a particular time. A plurality of devices 400 may also report to primary sensing device 100. According to an embodiment of the present invention, the user selects an Add Sensor button 370 shown on selection screen 300. The user must have at least one primary sensing device 100, used as a gateway device, registered or configured; this configuration occurs prior to assigning to it an auxiliary sensing device 400. If the user has multiple sensing device 100 units configured to act as wireless data gateways, the user is prompted to select the desired sensing device 100 for auxiliary sensing device 400 assignment, such as using device information on screen 300 or using a previous screen (not shown).

Figure 5:
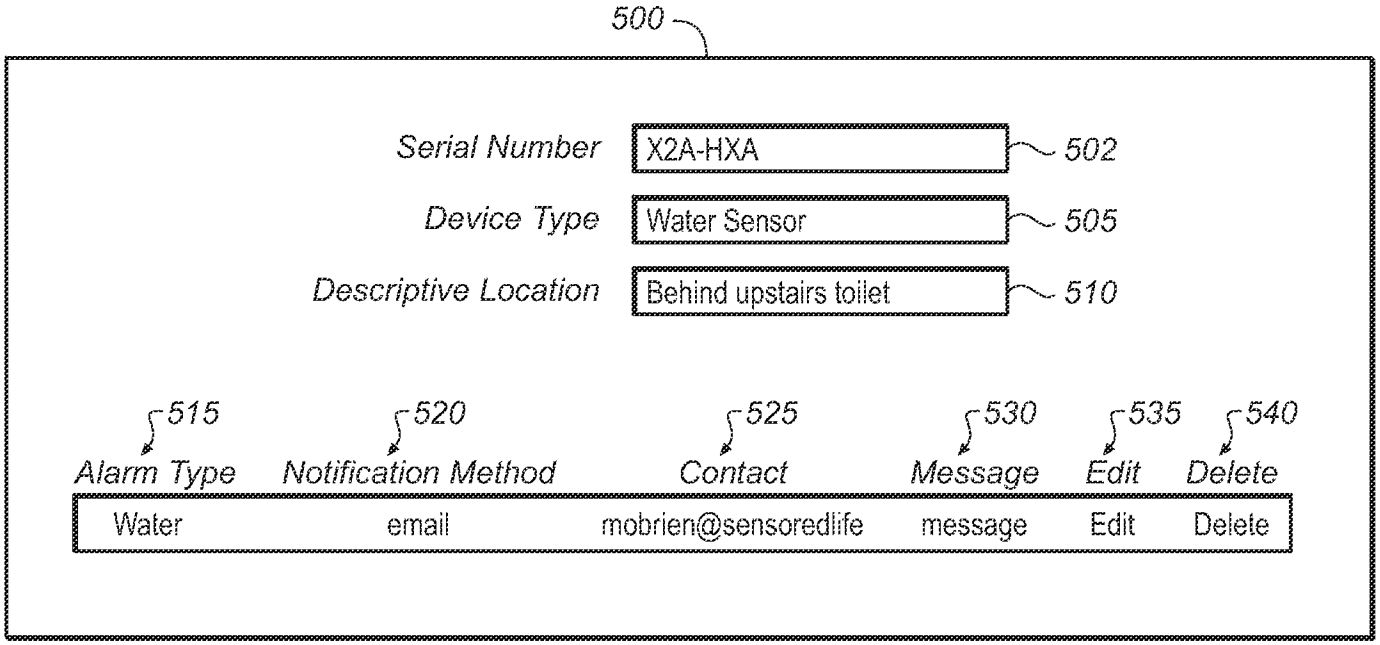
FIG. 5 illustrates a data entry screen enabling communication between an additional sensing device and the user.

FIG. 5 shows Add Sensor screen 500, which appears on computer 240 after connection to web server 230. According to an embodiment of the present invention, selection screen 500 is a web page that collects user input. The user enters the serial number assigned to auxiliary sensing device 400 on line 502. Once the serial number has been entered, the program providing screen 500 looks up whether or not this serial number corresponds to a valid device and to what type of device. Upon finding a valid device, the program automatically fills in the device type on line 505. To facilitate ease of use, a user selected name for the descriptive location for the device can be entered on line 510. Column 515 denotes the Alarm Type, in this case a water alarm, which is also supplied as the result of the user entering a valid serial number. Column 520 denotes the type of alarm that is to be delivered when device 400 is in an alarm sending state. When water is detected by device 400, device 400 is in an alarm sending state. In this example of screen 500, an email alert has been selected in column 520. However, a text message or a phone call can alternately be selected. Column 525 indicates the contact information that is to be used for alerts. This example shows email addresses because the notification method selected in column 520 is email. If a text message or phone message is selected, the phone number of the receiving personal communications device 250 is indicated. The desired message to be sent is selected in column 530. The user can view the current message in column 530 or change notification type 520 or contact 525 or message 530 by selecting editing column 535. Column 540 is used to delete all the information associated with a particular alarm type denoted in column 515.

The previously described embodiment is exemplary and is not considered to be limiting. For example, other initialization procedures can be used. Device 400 may first be selected on a screen similar to Add Sensor screen 500, and assigned to a particular sensing device 100 on that screen, or other subsequent screens.

When initialization is complete, auxiliary sensing device 400 and communication with primary sensing device 100 can be tested. With battery 415 enabled so that auxiliary sensing device 400 has power (FIG. 4), the user presses push switch 425. This initiates a transmission from auxiliary sensing device 400 to sensing device 100. If auxiliary sensing device 400 can establish communication with sensing device 100 and is recognized by sensing device 100 as the result of the initialization process previously described, controller 105 will cause LED Display 130 to indicate that sensing device 100 has received the transmission. According to an embodiment of the present invention, LED display 130 indicates transmission receipt by flashing 2 brief green blinks followed by a pause. This indicator sequence repeats for 60 seconds or other suitable interval, such as for an amount of time that is sufficient for an operator to return to sensing device 100 in order to verify receipt of transmission. Other LED illumination sequences could alternately be used.

Additional utility is added by adding additional auxiliary sensing devices 400 which report through primary sensing device 100. A plurality of devices 400, which may have different sensing abilities, and be in different locations, can be used to report specific conditions to a single primary sensing device 100. Differing types of conditions, and differing locations within the radio frequency range of primary sensing device 100 and auxiliary sensing devices 400 can be monitored via a single cellular or other wireless connection. Easy setup of communication and user alerts are accomplished via screen 300 and screen 500, or similar means.

According to an embodiment of the present invention, there is provided a system for remote monitoring of ambient conditions at a remote site, the system having a setup utility having at least one sensor; a control logic processor that is in signal communication with the sensor; and an operator interface that enables a user of the system to specify the sensor, a threshold condition to be sensed by the sensor, and a notification method for reporting the sensed condition to the user. According to an alternate embodiment of the present invention there is provided a method for remote reporting of ambient conditions at a remote site, the method comprising accepting one or more user instructions that identify the sensor, specify a threshold condition for reporting, and identify a notification method for remote reporting of the sensor condition; monitoring a signal from the sensor that is indicative of the threshold condition; and reporting the threshold condition according to the identified notification method.

Consistent with at least one embodiment, exemplary methods/apparatus can use a computer program with stored instructions that perform on data that is accessed from an electronic memory. As can be appreciated by those skilled in the sensor monitoring arts, a computer program of an embodiment herein can be utilized by a suitable, general-purpose computer system, such as a personal computer or workstation. However, many other types of computer systems can be used to execute the computer program of described exemplary embodiments, including an arrangement of networked processors, for example.

The computer program for performing methods of certain exemplary embodiments described herein may be stored in a computer readable storage medium. This medium may comprise, for example; magnetic storage media such as a magnetic disk such as a hard drive or removable device or magnetic tape; optical storage media such as an optical disc, optical tape, or machine readable optical encoding; solid state electronic storage devices such as random access memory (RAM), or read only memory (ROM); or any other physical device or medium employed to store a computer program. Computer programs for performing exemplary methods of described embodiments may also be stored on computer readable storage medium that is connected to the processor by way of the internet or other network or communication medium. Those skilled in the art will further readily recognize that the equivalent of such a computer program product may also be constructed in hardware.

It should be noted that the term "memory", equivalent to "computer-accessible memory" in the context of the present disclosure, can refer to any type of temporary or more enduring data storage workspace used for storing and operating upon data and accessible to a computer system, including a database, for example. The memory could be non-volatile, using, for example, a long-term storage medium such as magnetic or optical storage. Alternately, the memory could be of a more volatile nature, using an electronic circuit, such as random-access memory (RAM) that is used as a temporary buffer or workspace by a microprocessor or other control logic processor device. Display data, for example, is typically stored in a temporary storage buffer that can be directly associated with a display device and is periodically refreshed as needed in order to provide displayed data. This temporary storage buffer can also be considered to be a memory, as the term is used in the present disclosure. Memory is also used as the data workspace for executing and storing intermediate and final results of calculations and other processing. Computer-accessible memory can be volatile, non-volatile, or a hybrid combination of volatile and non-volatile types.

The invention has been described in detail with particular reference to certain preferred embodiments thereof, but it will be understood that variations and modifications can be effected within the spirit and scope of the invention.

The invention claimed is:

1. A method for monitoring at least one ambient condition at a remote site, the method executed at least in part by a computer and comprising:

configuring a first sensing device at the remote site according to one or more setup instructions transmitted wirelessly from a host processor at a first site, wherein the configuration associates the first sensing device with a first contact address of a first personal communications device, and wherein the configuration further specifies upper and lower values of a range for a sensed ambient condition, wherein the first sensing device is energizable to wirelessly transmit a sensor signal that indicates a change in the sensed ambient condition, according to the setup instructions;

and transmitting an alert message, in response to the transmitted sensor signal, to the first contact address of the first personal communications device that is associated with the first sensing device.

2. The method of claim 1 wherein configuring the first sensing device further comprises providing an email address as the first contact address for the transmitted alert message, wherein the first contact address identifies the first personal communications device at a second site that is different from the first site and from the remote site.

3. The method of claim 1 wherein configuring the first sensing device further comprises providing a phone number as the first contact address for the transmitted alert message, wherein the first contact address identifies the first personal communications device at a second site that is different from the first site and from the remote site.

4. The method of claim 1 further comprising configuring one or more additional sensing devices at the remote site for sensing one or more additional ambient conditions, configuring the one or more additional sensing devices for signal communication with the first sensing device, and displaying a listing of the one or more additional configured sensing devices and their associated ambient conditions at the first site.

5. The method of claim 1 wherein the first sensing device comprises a temperature sensor.

6. The method of claim 1 wherein the first sensing device comprises a humidity sensor.

7. The method of claim 1 wherein the first sensing device comprises a movement sensor.

8. The method of claim 1 wherein the first sensing device detects power loss.

9. The method of claim 1 wherein the setup instructions are transmitted using a cellular phone connection.

10. The method of claim 1 wherein the sensed ambient condition is a first ambient condition and further comprising configuring a second sensing device for sensing a second ambient condition at the remote site, wherein the configuration associates the second sensing device with a second contact address of a second personal communications device, wherein the second contact address differs from the first contact address.

11. The method of claim 10 wherein the first sensing device is configured to transmit the first sensor signal when the first ambient condition falls outside a first range of values and wherein the second sensing device is configured to transmit a second sensor signal when the second ambient condition falls outside a second range of values that differ from the first range of values.

12. The method of claim 1 wherein the first sensing device is configured to transmit the sensor signal at predetermined time intervals.

13. A method for monitoring at least one ambient condition at a remote site, the method executed at least in part by a computer and comprising:

configuring at least one sensing device at the remote site according to one or more setup instructions transmitted wirelessly from a host processor at a first site, wherein the configuration associates the at least one sensing device with a first contact address of a first personal communications device, wherein the at least one sensing device is energizable to wirelessly transmit, to the first personal communications device, a sensor signal that indicates that the at least one ambient condition is outside a threshold value range that is configured in the setup instructions;

and displaying, in response to the transmitted sensor signal, a warning message about the at least one ambient condition on the first personal communications device that is associated with the at least one sensing device and on a display that connects to the host processor at the first site.

14. The method of claim 13 wherein configuring the at least one sensing device further comprises configuring one or more additional auxiliary sensing devices at the remote site for monitoring one or more additional ambient conditions, wherein each of the one or more additional auxiliary sensing devices provides an auxiliary sensor signal to the at least one sensing device and displaying a listing of configured sensing devices and their associated ambient conditions and contact addresses on the display at the first site.

15. The method of claim 14 further comprising configuring the one or more additional sensing devices to communicate with the first personal communications device through the at least one sensing device.

16. The method of claim 13 wherein the at least one sensing device detects one or more of temperature, humidity, pressure, power loss, vibration, water, noise, light, and movement.

17. The method of claim 13 wherein the at least one sensing devices provides an indicator to indicate established communication with the one or more additional auxiliary sensing devices.

18. A method for monitoring at least one ambient condition at a remote site, the method executed at least in part by a computer and comprising:

configuring at least one primary sensing device at the remote site according to one or more setup instructions transmitted wirelessly from a host processor at a first site, wherein the configuration associates the at least one primary sensing device with a contact address of a personal communications device, wherein the at least one primary sensing device is energizable to wirelessly transmit, to the personal communications device, a primary sensor signal that indicates a change in the at least one ambient condition that is configured in the setup instructions;

configuring at least one auxiliary sensing device at the remote site for monitoring one or more additional ambient conditions, wherein the configuration associates the at least one auxiliary sensing device with the at least one primary sensing device and wherein at least one auxiliary sensing device is energizable to transmit an auxiliary sensor signal to the at least one primary sensing device for transmission of a third sensor signal from the at least one primary sensing device that indicates a change in the one or more additional ambient conditions monitored by the auxiliary sensing device;

and displaying, on a first display of the personal communications device that is associated with the at least one primary sensing device and on a second display that is associated with the host processor, in response to the transmitted third sensor signal, information about the one or more additional ambient conditions monitored by the at least one auxiliary sensing device.

* * * * *